United States Patent [19]

Smalley, III

[11] Patent Number: 4,777,774

[45] Date of Patent: Oct. 18, 1988

[54] BUILDING CONSTRUCTION UTILIZING PLASTIC COMPONENTS

[76] Inventor: Arthur L. Smalley, III, P.O. Box 8241, The Woodlands, Tex. 77387

[21] Appl. No.: 61,283

[22] Filed: Jun. 9, 1987

[51] Int. Cl.[4] ..... E04B 1/00

[52] U.S. Cl. ..... 52/282; 52/582

[58] Field of Search ..... 52/234, 282, 582, 721

[56] References Cited

U.S. PATENT DOCUMENTS

| | | | |
|---|---|---|---|
| 2,844,848 | 7/1958 | Couse et al. . | |
| 3,685,222 | 8/1972 | Curtess | 52/282 X |
| 3,760,551 | 9/1973 | Konig | 52/282 X |
| 3,783,563 | 1/1974 | Moore . | |
| 3,789,556 | 2/1974 | Skinner . | |
| 3,828,496 | 8/1974 | Testaguzza et al. . | |
| 4,004,387 | 1/1977 | Ellingson . | |
| 4,222,606 | 9/1980 | Brown et al. | 52/282 X |
| 4,373,304 | 2/1983 | Howitt | 52/282 X |
| 4,418,508 | 12/1983 | Gilliland et al. | 52/282 |
| 4,557,091 | 12/1985 | Auer | 52/282 |
| 4,577,449 | 3/1986 | Celli | 52/721 |
| 4,587,783 | 5/1986 | McCoy et al. | 52/282 |
| 4,615,155 | 10/1986 | Chamberlain . | |
| 4,621,467 | 11/1986 | Golden . | |
| 4,676,038 | 6/1987 | Doyon et al. | 52/282 |

FOREIGN PATENT DOCUMENTS

| | | | |
|---|---|---|---|
| 2058871 | 4/1981 | United Kingdom | 52/282 |

*Primary Examiner*—Carl D. Friedman
*Assistant Examiner*—Creighton Smith
*Attorney, Agent, or Firm*—Gunn, Lee & Jackson

[57] ABSTRACT

In a building system, extruded plastic panel components are joined together to form a building structure. External and internal connectors adhesively join the panel components together to form a completed structure. The panel components are internally ribbed and may be partially or fully insulated. Internal conduits in the panel components provide passageways for electrical wiring, plumbing and other required utilities.

33 Claims, 6 Drawing Sheets

FIG. 15
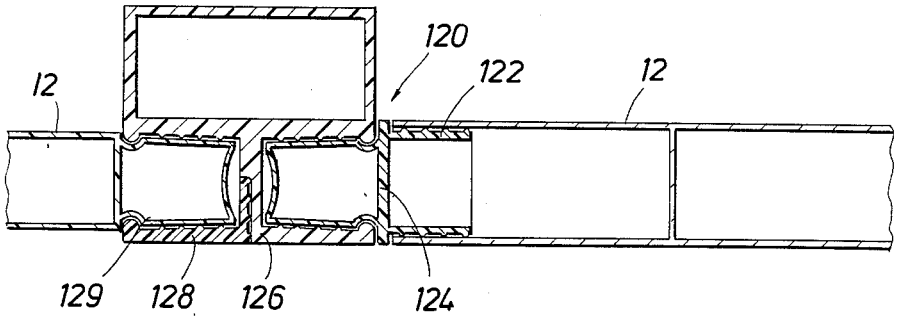
FIG. 16
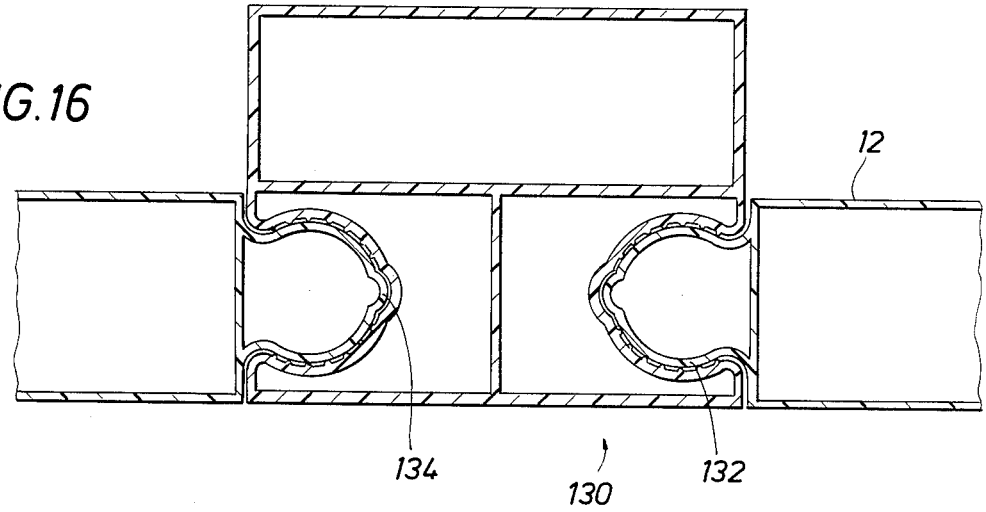
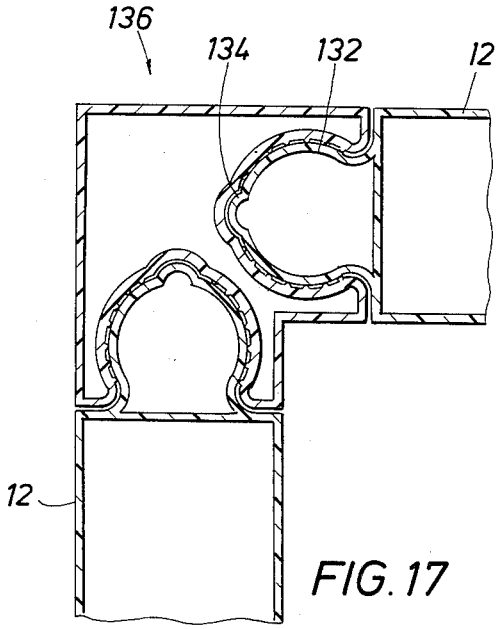
FIG. 17
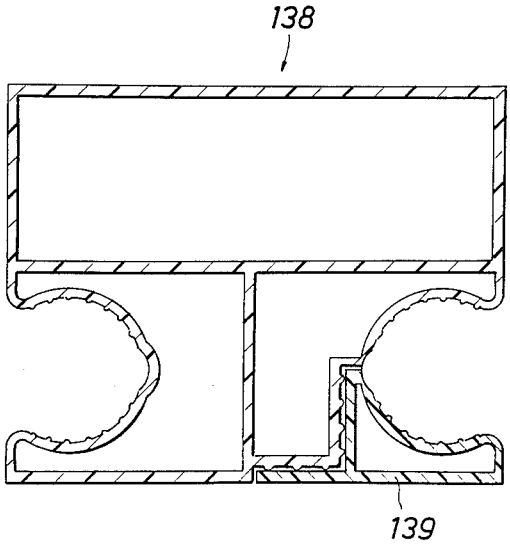
FIG. 18

BUILDING CONSTRUCTION UTILIZING PLASTIC COMPONENTS

BACKGROUND OF THE DISCLOSURE

The present invention is directed to building construction, particularly, building construction utilizing plastic components to form the building structure.

There has long been a need for affordable, low-maintenance, building structures for both residential and commercial use. In the past decade, building construction costs on a cost per square foot basis have doubled and in some areas of the country have tripled or quadrupled. Consequently, in today's market, affordable housing is not available to many consumers. Likewise, soaring building construction costs have prevented many small and medium sized companies from building needed storage and warehouse facilities.

Attempts have been made to provide inexpensive building units. U.S. Pat. No. 3,783,563 discloses a building structure employing modular components formed of molded plastic material, reinforced with glass fibers. The panels may be used to form roofs, ceilings, sidewalls and floors. The panels include passage ways for electrical wiring, heating, water and waste material.

U.S. Pat. No. 3,828,496 disloses a building structure including a prefabricated base, wall units and roof units. The wall and roof units include at least one panel with a hollow portion therein. The wall and roof units cooperate so that when they are placed in position, the hollow portions thereof are in communication. Concrete is poured through the openings to provide a unitary structure.

U.S. Pat. No. 4,621,467 discloses a building structure that is formed out of extruded, plastic components. The components snap together but may also be assembled with adhesives or glues. The building structure is formed with vertical walled, elongated triacontahedral structures clustered together to form a building.

The above-noted patents, however, do not disclose a building system solely utilizing plastic components which are adhesively joined together to form a building structure. It is, therefore, an object of the present disclosure to provide a building sytem utilizing extruded, internally ribbed plastic components to form the building structure. The components of the system of the invention are delivered to the building site for assembly of the building structure.

SUMMARY OF THE INVENTION

The present invention comprises a building system of extruded plastic panel components joined together to form the building structure. The extruded plastic components include a combination of various plastics providing strength, fire retardation and ultraviolet light resistance. The components are provided with connectors for joining the components together to form a completed structure. The components are glued at the connector surfaces to form a permanent structure. The panel components are internally ribbed and may include insulation. Internal conduits in the panels provide passage ways for air conditioning, electrical wiring, plumbing and other required utilities.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 13–18 are sectional views illustrating different embodiments of the connector numbers of the invention;

DETAILED DESCRIPTION OF THE PREFERRED EMBODIMENT

Figures 1, 2:
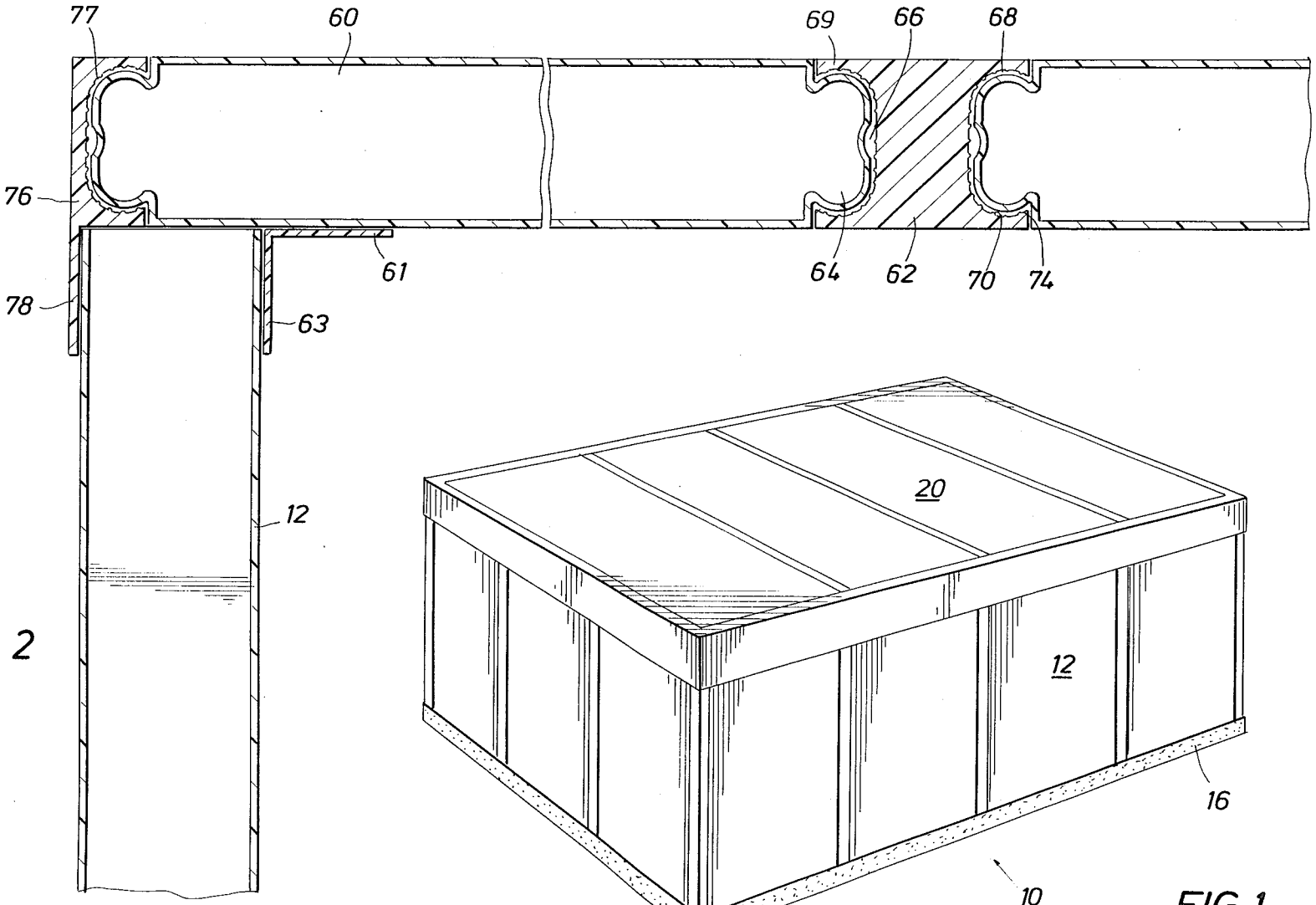
FIG. 1 is a perspective view illustrating a representative building structure capable of assembly from the components of the present invention.
FIG. 2 is a fragmentary enlarged sectional view of the roof panels of the invention supported at one end by a wall panel.

Referring first to FIG. 1, a representative building constructed of components of the present invention is generally identified by the reference numeral 10. The floor, walls, and roof of the building 10 are formed with building components of the invention as will be fully described hereinafter. Doors and windows are not shown in FIG. 1; it is understood, however, that doors and windows are incorporated in the building 10 at desired locations.

Figure 3:
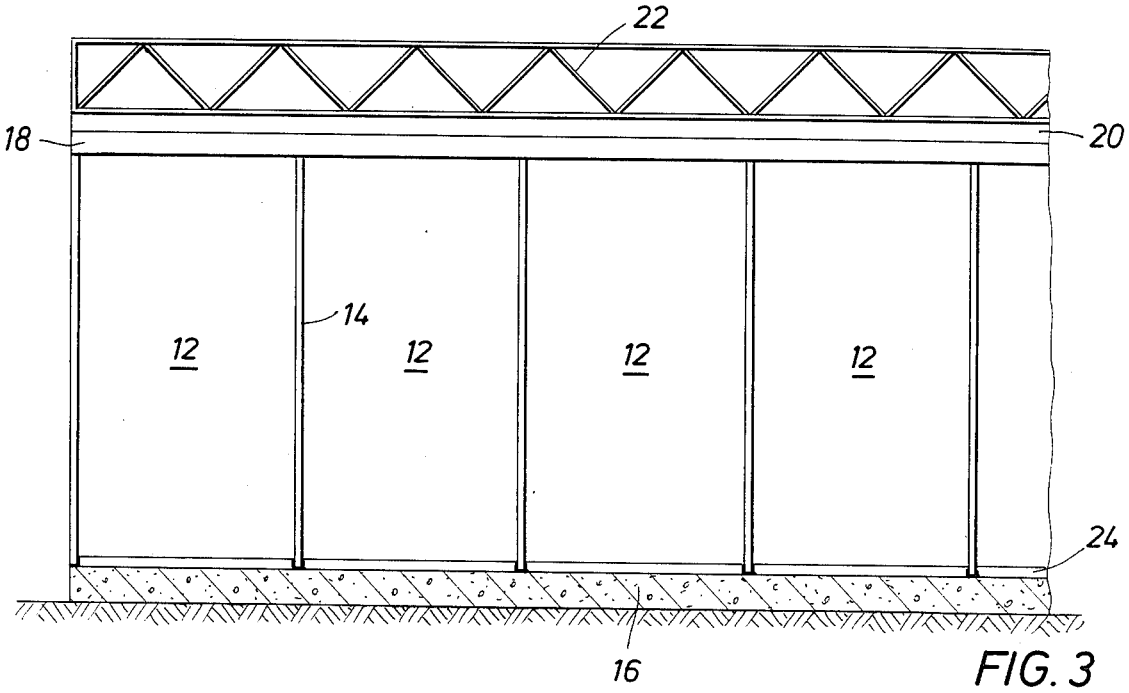
FIG. 3 is a side elevational view of panel components joined together to form a wall structure.

Referring now to FIG. 3, a plurality of wall panels 12 joined end to end form a portion of an outer wall of the building 10. The wall panels 12 are connected by vertical panel connectors 14 which extend from the foundation 16 to a horizontal connector panel 18. Roof panels 20 are supported across the top of the wall panels 12. For additional structural support, a plastic truss component 22 may be mounted above the roof panels 20.

Figure 11:
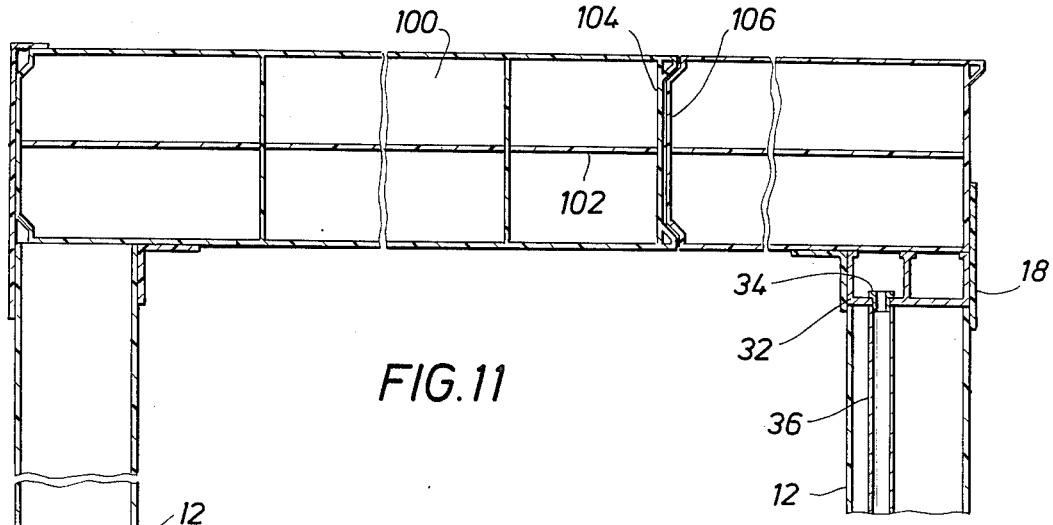
FIG. 11 is a sectional view of an alternate embodiment of a wall panel and roof panel of the present invention.

A floor plate 24 anchored to the concrete foundation 16 supports the lower ends of the wall panels 12. The floor plate 24 forms a generally U-shaped channel for receiving the lower end of the wall panels 12 therein. The wall panels 12 when assembled are glued to the floor plate 24. In FIG. 11, the floor plate 24 is shown in greater detail. The floor plate 24 is a two-piece assembly including an external floor plate member substantially L-shaped in cross section. The external floor plate member is formed by a base 26 which may be glued or otherwise anchored to the foundation 16 and an upstanding external flange 28. An internal floor plate flange 30 cooperates with the base member 26 to form the substantially U-shaped profile. The base member 26 is relieved at the internal longitudinal end thereof forming a gap between the internal edge of the base member 26 and the foundation 16. The gap is sized to receive a leg member of the interior floor plate flange 30 which is glued to the lower end of the wall panels 12 and to the plate member 26 providing additional rigidity to the floor connection.

Referring again to FIG. 11, the wall panels 12 of the invention are shown in greater detail. The wall panels 12 may be hollow as shown in FIG. 11 or filled with insulation. Foam insulation may be injected into the wall panel cavities as required. Alternatively, the wall panel 12 may be ribbed so that they may be partially filled with insulation. The wall panels 12 are provided with passage ways, conduits or ducts for installation of plumbing and electrical wiring. An electrical chase is installed at the top of the wall panels 12 or may be integrally formed therewith. The electrical chase 32 is glued to the top of a wall panel and the bottom of a roof panel. The external connector 18 provides additonal support and secures the electrical chase 32 to the wall panels 12. An electrical conduit cap 34 provides access to the electrical conduit 36 which extends from the switch or outlet box 38 (shown in FIG. 4) to the electrical chase 32.

Figure 4:
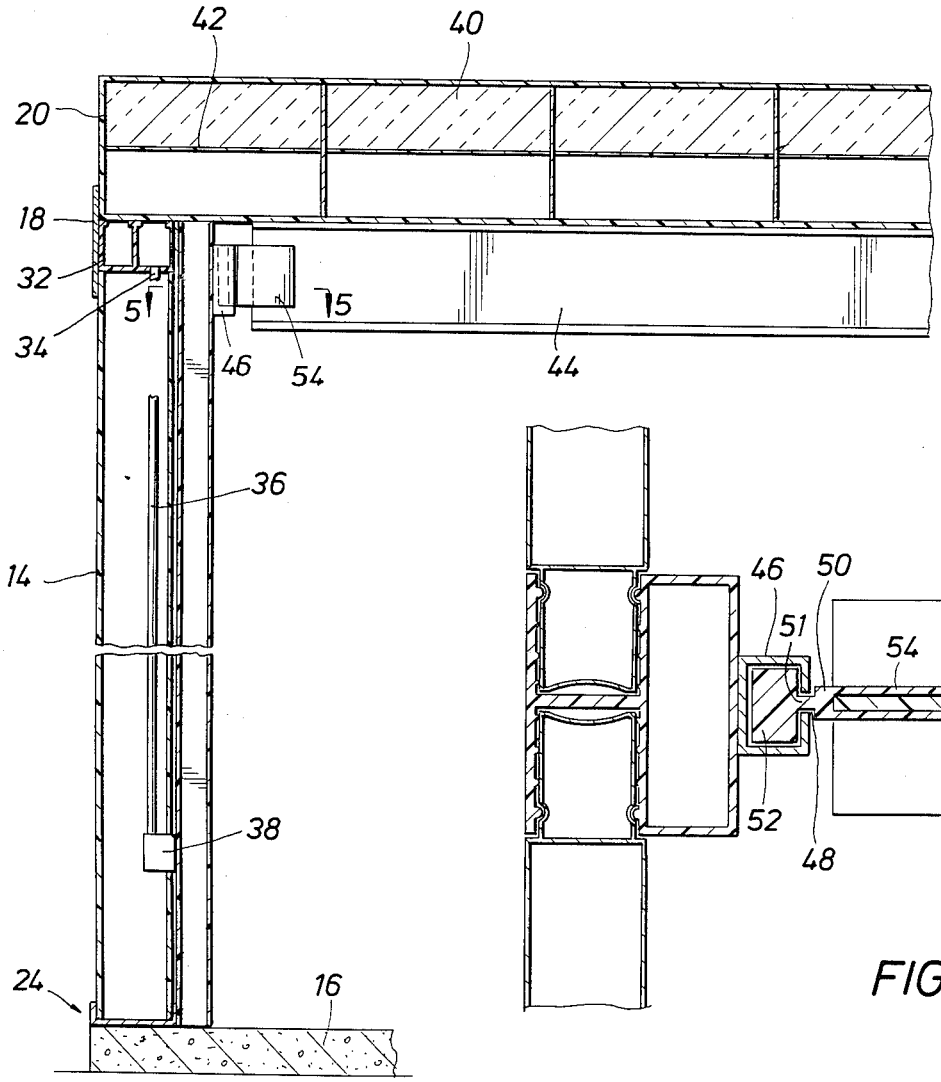
FIG. 4 is a partial sectional view of a wall panel and roof panel joined by panel connectors.

The roof of the building structure, as shown in FIG. 3, is formed by a plurality of roof panels 20 joined end to end in much the same fashion as the wall panels 12. The roof panels 20 are extruded ribbed panels which may be partially or fully insulated. In FIG. 4, the roof panels 20 are shown partially filled with insulation 40. The unfilled cavity may be used as an air conditioning duct if the building 10 is provided with an air conditioning system. The roof panels 20 are divided by integrally formed ribs 42, thereby forming two separate cavities within each roof panel 20. The wall panels 12 and roof panels 20 define unitary panel components joined in the manner described.

Figure 5:
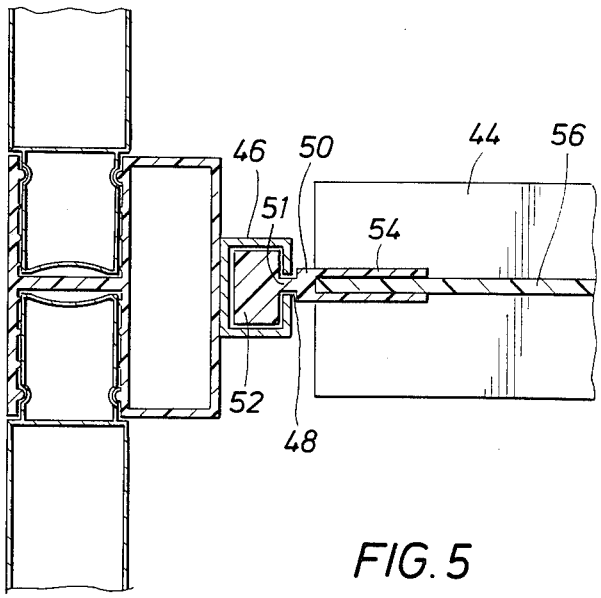
FIG. 5 is a sectional view taken along line 5—5 of FIG. 4.

The wall panels 12 and roof panels 20 have sufficient thickness and rigidity to support structural load forces, both vertical and horizontal. Additional support, praticularly for large ceiling or floor expanses, may be provided by a plastic I-beam member 44. The I-beam member 44 is supported between connector members 14 of the configuration shown in FIG. 5. The connector member 14 is provided with a connector receptacle 46. The receptacle 46 is glued to connector member 14 when required to support the I-beam member 44. The receptacle 46 is open at its top end and closed at its bottom end. A slot 48 incorporated in a vertical wall of the receptacle 46 enables a slip connector 50 to be received within the cavity formed by the receptacle 46. The slip connector 50 includes a head 52 and a clip member extending from the head 52 and connected thereto by a neck member 51. The neck 51 is sized to be snugly received in the slot 48. The clip member is formed by two spaced fingers 54 defining a slot therebetween for receiving the vertical component 56 of the I-beam 44. A slip connector 50 is securely glued to each end of the I-beam 44 so that it may be supported between spaced connectors 14 provided with a reciprocal 46 in the manner shown in FIG. 4.

Referring now to FIG. 2, an alternate embodiment of the roof panels of the invention is shown. The roof panels 60 are connected end to end by panel connectors 62. The roof panels 60 comprise a unitary body similar to the roof panels 20. Interiorly, the roof panels 60 may include interior webbing for additional strength and the formation of interior cavities which may be filled with insulation if added insulative characteristics are desired. The ends of the roof panels 60 are provided with a protruding bulb-like head 64. At its most forward end, the head 64 is depressed slightly to form a glue recess 66 along its full length. The glue recess 66 provides a reservoir for excess glue when the roof panel 60 and connector 62 are joined. The head 64 is received in a cavity 68 formed in the connector 62. The entrance to the cavity 68 is defined by flexible flange members 69 which flex outwardly permitting the head 64 of the roof panels 60 to be inserted into the cavity 68. The interior of the cavity 68 is provided with a plurality of nodules 70 which grip the head 64 and aid in containing the glue so that it is evenly distributed as the head 64 is inserted into the cavity 68. Larger nodules 74 adjacent the ends of the flexible flange members form a stop or barrier along the head 64 to prevent the glue from seeping out of the cavity 68.

An end connector 76 joins the roof panel 60 to a wall panel 12. The end connector 76 includes a cavity 77 for receiving the head 64 of the roof panels 60. The end connector 76 is provided with an integral connector plate 78 which extends downwardly and overlaps the exterior of the wall panel 12. The end connector 76 is glued to the exterior of the wall panel 12. A right angle internal flange connector connects the interior upper surface of the wall panel 12 with the lower or bottom surface of the roof panel 60. The internal flange connector member is formed by two flange members 61 and 63 which are at the right angles to each other and form an integral single connector.

Figure 6:
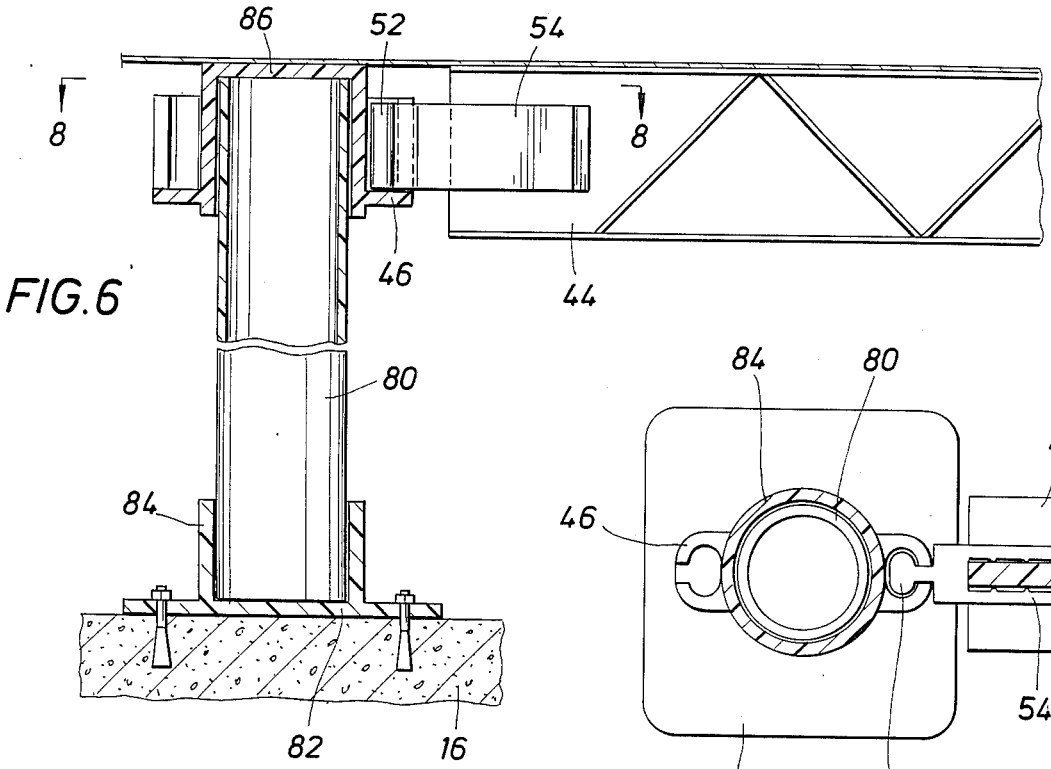
FIG. 6 is a sectional view of a support column and slip connector of the invention.
Figure 8:
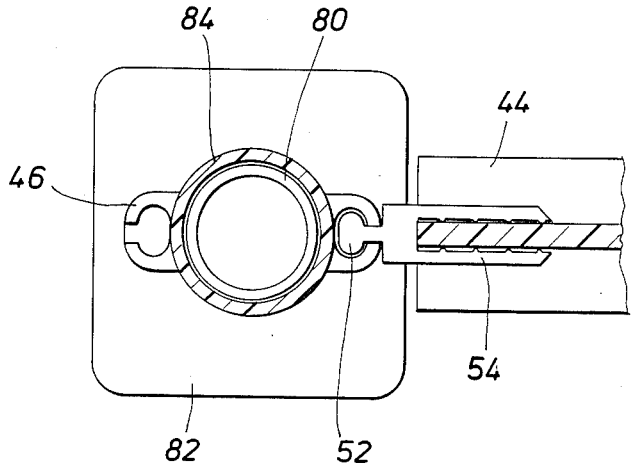
FIG. 8 is a sectional view taken along line 8—8 of FIG. 6.
Figure 7:
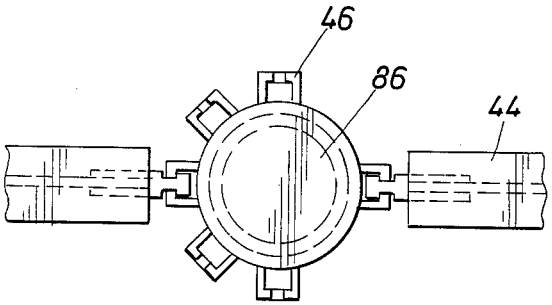
FIG. 7 is a plan view of the support column and slip connector of the invention.

In FIG. 6, a support column 80 is shown. Support columns may be positioned throughout the building structure 10 to provide additional support for the roof panels and as support members for the I-beam members 44. The lower end of the support column 80 is received and glued to a floor flange 82 which is anchored to the foundation 16. The floor flange 82 is provided with an upstanding circumferential flange 84 integrally formed with the floor flange 82. The circumferential flange 84 defines a cavity for receiving the lower end of the support column 80 and provides a gluing surface therewith. A cap 86 is supported about the upper end of the support column 80. The cap 86 slips over the upper end of the support column 80 and rests on the top thereof. The cap 86 may be glued to the support column 80 if desired. Integrally formed with the cap 86 is one or more receptacles 46. As best shown in FIG. 7, the receptacles 46 may extend radially outwardly from the column cap 86 so that beam supports 44 may extend from the support column 80 at various angles.

Figure 10:
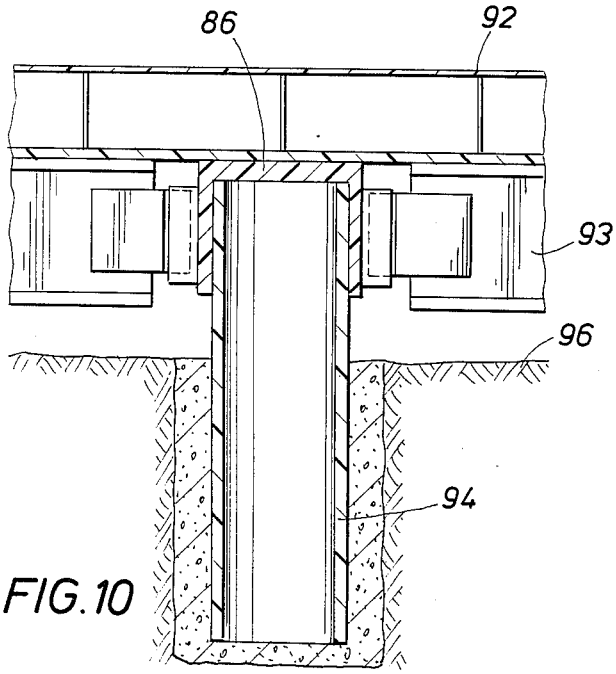
FIG. 10 is a sectional view taken along line 10—10 of FIG. 9.
Figure 9:
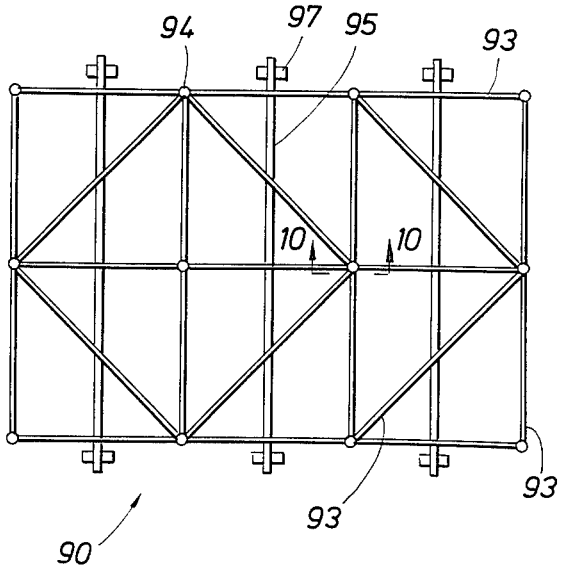
FIG. 9 is a plan view of the building foundation capable of assembly from the components of the present invention.

Referring now to FIGS. 9 and 10, a floor panel assembly generally identified by the reference numeral 90 is shown. The floor panel assembly 90 is formed by a plurality of unitary panels 92 joined end to end in much the same fashion as the roof panels and may be utilized when concrete floor for the building 10 is not available or feasible. The floor panels 92 are extruded unitary hollow bodies which may be ribbed and filled with polyfoam or other insulative material. The floor panels 92 are supported on a plurality of foundation columns 94 which have been driven into the ground surface 96 and cemented in place. The foundation columns 94 are capped with column caps 86 enabling support beams 93 to be mounted between foundation columns 94 to provide support for the floor panels 92. As shown in FIG. 9, the support beams 93 may extend angularly between foundation columns 94 beneath the floor panels 92 providing additional support for the floor panels 92. During assembly, the support beams 93 are supported on temporary supports 95 mounted on leveling blocks or jacks 97. The temporary supports 95 aid in assembling the support beams 93 between the foundation column 94 to provide a level support structure for the floor panels 92.

Referring now to FIG. 11, an alternate embodiment of the roof panels of the invention is shown. The roof panels 100 are substantially identical to the roof panels previously discussed. The roof panels 100 are formed of extruded plastic material and include an internal rib or web 102 which add rigidity to the roof panels 100. The web 102 divides the roof panels 100 so that separate cavities are formed. The cavities may be filled with insulation if required. The ends of the roof panels 100 are tapered inwardly to form a receiving cavity 104 at one end and a projection or protrusion 106 at the opposite end. The protrusion 106 is profiled to be snugly received within the cavity 104 and glued therewith.

Figure 12:
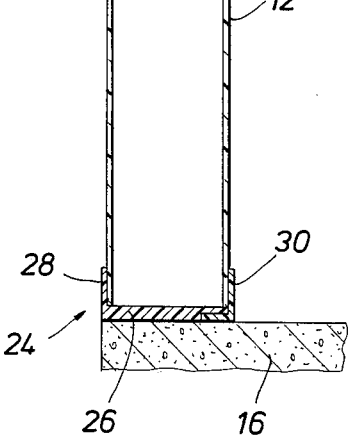
FIG. 12 is a partial sectional view of panels of the invention joined together and showing a laminated skin mounted to the exterior of the assembled wall panels.
Figure 13:
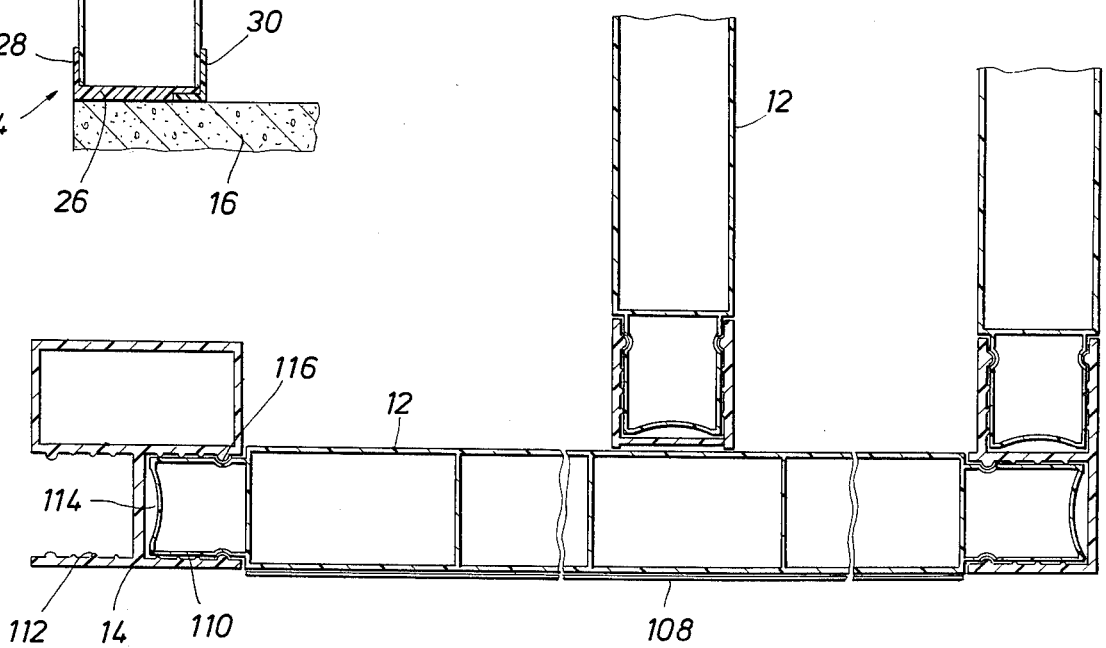
Figure 13:
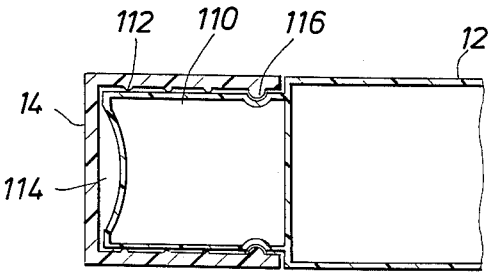
Figure 14:
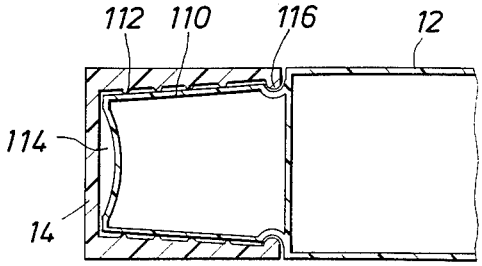
Figure 19:
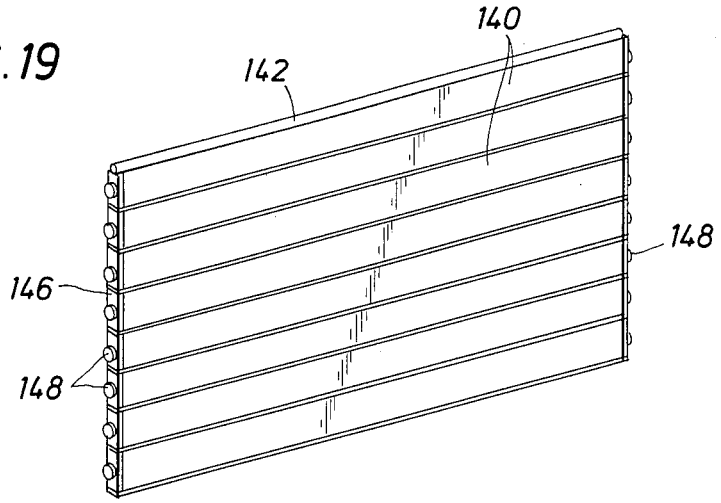
FIG. 19 is an elevational view of a garage door capable of assembly from the components of the present invention.
Figure 20:
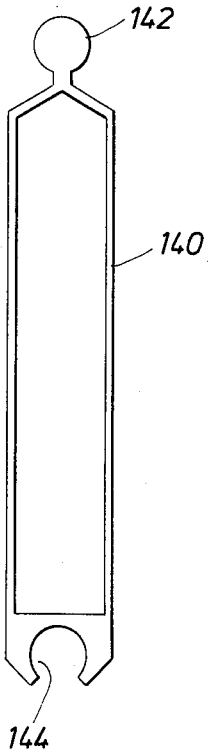
FIG. 20 is a sectional view of the garage door panel.
Figure 21:
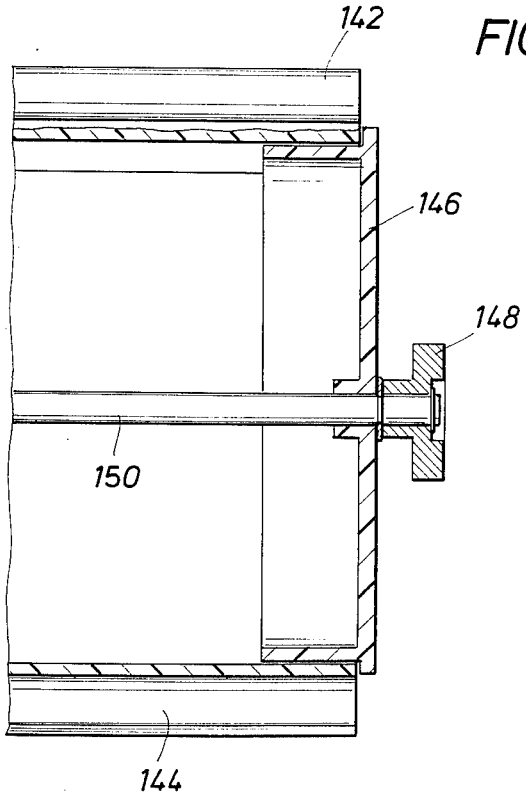
FIG. 21 is a sectional view of the garage door panel showing an end cap mounted at each end of thereof and a reinforcing member extending longitudinally through the garage door panel.
Figure 22:
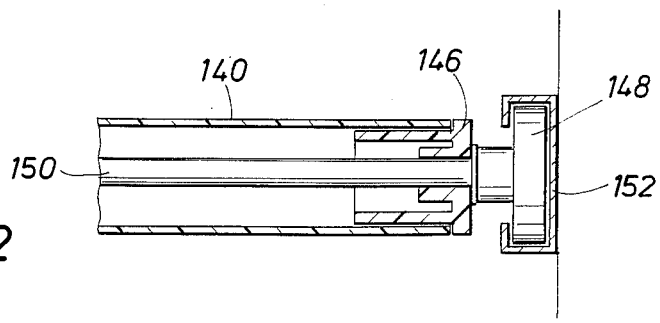
FIG. 22 is a sectional view of the garage door panel of the invention illustrating its cooperation with the garage door track.

Upon completion of the wall assembly, the external surface of the building structure may be laminated with a skin 108 if desired, as shown in FIG. 12. The skin 108 may be of any desired color so that the exterior of the building structure may blend aesthetically with the surrounding environment. Additionally, the skin 108 may embody ultraviolet protective properties, thereby protecting the structural members of the building 10 from long term exposure to the sun.

Referring now to FIGS. 13 through 18, collectively, various embodiments of the connector/adapter 110 of the invention are shown. The connector 10 is an integral protrusion extending along the vertical edge of the wall panel 12. The connector 10 is received by mating connector 14. The connector 14 is substantially U-shaped in cross section presenting an open channel for insertion of the connector 110. The channel of the connector 14 is provided with nodules 112 which aid in the disbursement of the glue and grip the surface of the connector 110. The end face of the connector 110 is concave defining a glue reservoir 114. The glue reservoir 114 forms a collection area for glue. Larger nodules 116 are provided adjacent the open end of the connector 14 which are received in grooves formed in the connector 110 so that the two members may snap together when properly connected. Additionally, the nodules 116 form a seal about the connector 110 so that the glue does not seep out.

In FIG. 15, a modified connector is shown. Occasionally, a wall panel 12 may require cutting or trimming to fit in a particular location. The panel connector must therefore be removed leaving the wall panel 12 with a vertical edge without a panel connector. For this purpose, a connector adapter 120 is provided. The connector adapter 120 includes spaced and parallel extension members 122 extending perpendicularly from the connector base 124. The extension members 122 stab into the open cavity of the wall panel 12 and are glued thereto, providing a panel connector for the wall panel 12 for insertion into the connector 14.

When connecting the wall panel 12 to form the building structure 10, sufficient room may not be available, particularly at the corner, to stab the panel connector into the end connector. The panel connector must therefore be inserted laterally. A modified connector 126 is provided which includes a removable connector section 128. When removed, the connector section 128 exposes the connector cavities so that the panel connector 129 may be slid into position laterally, and once in position, the connector member 128 is positioned about the panel connector 129 and glued to the connector 126 and the panel connector 129 as shown in FIG. 15.

In FIGS. 16 through 18, a modified connector 130 is shown. As previously mentioned, occasionally it is difficult to align the panel connectors so that they may be stabbed together. The bulb-like configuration of the connector 130 shown in FIGS. 16 through 18 permit the wall panel connectors to be inserted into the receiving connectors at a slight angle and rotated to the fully engaged position. It is noted that the receiving cavities of the connector 130 conform to the shape of bulb-like extension 132 of the wall panels 12. The connector cavities include a glue reservoir formed by a concave recess. The extension 134 of the wall panels 12 includes a protrusion 134 which extends into the glue recess and thereby forcing the glue outward and around the extension 132 of the wall panels 12. Thus, the glue is disbursed substantially evenly about the connector extension 132 rather than being scraped to one side as the wall panels 12 are rotated into position.

In FIG. 17, a corner connector 136 is shown. The corner connector 136 is similar in configuration to the connector 130 and therefore like reference numerals are used to designate like elements. Likewise, the connector 138 shown in FIG. 18 is similar in configuration to the connector 130. Additionally, the connector 138 includes a removable member 139 for permitting lateral access to the receiving cavity of the connector 138.

Referring now to FIGS. 19 through 22, the garage door configuration of the present invention is shown. The garage door is formed by a series of interconnected panels 140. The panels 140 are formed of extruded plastic and may be foam-filled if desired. The panels 140 are approximately 4" to 6" in height and 8' and 16' in width for a single or double width garage door. The panels 140 include an integral head 142 extending across the top edge thereof. Across the lower edge of the panel 140, a slot is formed for receiving the head 142. The garage door is formed by sliding the head 142 of one panel 140 into the slot 144 of another panel 140. A number of garage door panels 140 are connected in this manner to form the required height of the fully extended garage door. The vertical ends of the panels 140 are closed by a cap member 146 which includes a roller 148 projecting therefrom. For additional rigidity, a steel or plastic rod 150 may be incorporated in the panel 140 extending between opposed cap members 146. The assembled garage door may be installed and operated in a typical fashion. The interconnected garage door panels 140 are positioned so that rollers 148 engage a garage door track 152 mounted to the wall of the building structure 10. The garage door panels 140 pivot relative to each other so that the garage door opens and closes in a typical fashion.

As set forth above, the invention of the present disclosure provides a totally plastic building structure which may be assembled in a relatively short period of time and requiring a minimum of tools. It is understood that the building structure formed by the panel components of the invention will include window and door openings and framing therefore. The exterior of the building structure may be laminated or textured to add individuality and exterior decorations to the structure.

While the foregoing is directed to the preferred embodiments of the present invention, other and further embodiments of the invention may be devised without departing from the basic scope thereof, and the scope thereof is determined by the claims which follow.

What is claimed is:

1. A building structure having a roof, walls and flooring supported on a foundation, comprising:

(a) a plurality of rigid plastic panel members joined end to end for forming the roof, walls and flooring of said building structure;

(b) connector means for joining said panel members in end-to-end relationship;

(c) means for anchoring said panel members forming the walls of said building structure to the building foundation; and (d) support means incorporated in said building structure for providing additional support for said penal members forming said building structure, said support means including an I-beam member supported for engaging said panel member forming the roof of said building structure, said I-beam member being supported at each end by receptable connectors mounted to said connector means.

2. The building structure of claim 1 wherein said panel members comprise extruded plastic material formed to define a generally flat, hollow panel body.

3. The building structure of claim 2 wherein said panel members are filled with insulation.

4. The building structure of claim 2 wherein said hollow panel body of said panel members is divided by integrally formed ribs defining separate cavities within said panel members.

5. The building structure of claim 4 wherein said cavities of said panel members are filled with insulation.

6. The building structure of claim 4 wherein said cavities of said panel members are partially filled with insulation.

7. The building structure of claim 1 wherein said connector means includes external end connectors and internal flange connectors, said external end connectors and internal flange connectors adhesively joining said panel members to form the building structure.

8. The building structure of claim 7 whrein said end connectors include a body portion defining a cavity profiled to receive an end of said panel members therein.

9. The structure of claim 8 wherein said cavities of said end connectors include nodules formed on the interior surface of said cavities for gripping the end of said panel members.

10. The building structure of claim 9 wherein said cavities of said end connectors are provided with glue which is dispersed upon insertion of the panel members into said end connectors, said end connectors being further provided with enlarged nodules adjacent the entry of said connector cavities, said enlarged nodules being received in grooves formed along the end of said panel members for preventing seepage of glue out of said cavities upon assembly of said end connectors with said panel members.

11. The building structure of claim 7 wherein said internal flange connectors are formed by two integral right angle flange members adhesively joining said panel membes forming the roof and walls of said building structure.

12. The building structure of claim 8 wherein said end connectors include a removable connector section which upon removal exposes said cavity permitting the end of said panel members to be laterally positioned in said cavity, said removable connector section being glued to said body portion of said end connectors upon positioning of the end of said panel members in said connector cavity.

13. The building structure of claim 8 wherein said cavity defined by said body portion is sized to receive a bulb-like connector forming the end of said panel members, said cavity including a longitudinal groove for temporary storage of glue.

14. The building structure of claim 13 wherein said bulb-like connector includes a protrusion extending therefrom received by said longitudinal groove for forcing the glue stored therein outward and around the bulb-like connector upon assembly of said panel members with said end connectors.

15. The building structure of claim 1 wherein said anchor means comprises a two-piece floor plate assembly including an external floor plate member anchored to the foundation and an internal floor plate flange cooperating with said floor plate member to form a substantially U-shaped profile for receiving a lower end of said panel members, wherein said external floor plate member and said internal floor plate flange are glued to the lower end of said wall panels.

16. The building structure of claim 1 wherein said receptacle connectors are open at one end and closed at the opposite end and include a slot along a vertical wall of said receptacle connector for receiving a slip connector attached to the ends of said I-beam member.

17. The building structure of claim 1 including a garage door formed by a series of interconnected panels, said garage door panels including an integral head extending across a top edge theeof and a slot extending across a lower edge thereof, wherein said garage door is formed by connecting a series of said garage door panels by sliding said head of a garage door panel into said slot of an adjacent garage door panel.

18. The building structure of claim 18 wherein said garage door panels are closed by end cap members including a roller projecting therefrom, wherein said roller engages a garage door track mounted to a wall of the building structure for operation of said garage door.

19. The building structure of claim 19 wherein said garage door panels include a reinforcing rod extending between said end cap members mounted to the ends of said garage door panel.

20. The building structure of claim 1 wherein support means include a support column positioned between the roof and flooring of said building structure, said support column including a slip connector mounted over the upper end of said support column, said slip connector including receptacle connectors attached radially about said slip connector.

21. The building structure of claim 20 wherein said receptacle connectors are equally spaced about said slip connector and are an integral component of said slip connector.

22. The building structure of claim 1 wherein said support means includes foundation supports positioned below the flooring of said building structure for supporting I-beam members extending below the flooring of said building structure.

23. The building structure of claim 22 including slip connectors mounted over the upper end of said foundation supports, said slip connectors including receptacle connectors equally spaced about said slip connector for supporting said I-beam members at differing angular positions about said foundation supports.

24. The building structure of claim 23 including temporary supports means for supporting said panel members forming the flooring of said building structure.

25. The building structure of claim 2 wherein said panel members include an electrical chase mounted across the upper end of said panel members.

26. The building structure of claim 2 wherein said panel members include an electrical chase integrally formed therewith across the upper end of said panel members.

27. A building structure having a roof, walls and flooring supported on a foundation, comprising:

(a) a plurality of rigid plastic members joined end-to-end for forming the roof, walls and flooring of said building structure;

(b) connector means for joining said panel member in end-to-end relationship, said connector means including a body portion defining a cavity profiled to receive an end of said panel members therein, and wherein said cavity includes nodules formed on the interior surface of said cavity for gripping the end of said panel members received within said cavity;

(c) means for anchoring said panel members forming the wall of said building structure to the building foundation;

(d) support means for providing additional support for said panel members forming the roof of said building structure; and (e) wherein said cavity of said connector means is coated with glue which is dispersed upon insertion of a panel member end into said cavity, said connector means including enlarged nodules adjacent the entry of said cavity, said enlarged nodules being received in grooves formed along said panel member ends for preventing seepage of glue out of said cavity upon assembly of said end connector means with said panel members.

28. The building structure of claim 27 including external end connectors and internal flange connectors adhesively joining said panel members to form the building structure.

29. The building structure of claim 27 wherein said connector means includes a removable connector section which upon removal exposes said cavity permitting the end of said panel members to be laterally positioned in said cavity, said removable connector section being glued to said body portion of said connector means upon positioning of the end of said panel members in said cavity.

30. The building structure of claim 27 including a garage door formed by a series of interconnected panels, said garage door panels including an integral head extending across a top edge thereof and a slot extending across a lower edge thereof, wherein said garage door is formed by connecting a series of said garage door panels by sliding said head of a garage door panel into said slot of an adjacent garage door panel.

31. The building structure of claim 30 wherein said garage door panels are closed by end cap members including a roller projecting therefrom, wherein said roller engages a garage door track mounted to a well of the building structure for operation of said garage door.

32. The building structure of claim 31 wherein said garage door panels include a reinforcing rod extending between said end cap members mounted to the ends of said garage door panel.

33. The building structure of claim 27 wherein said support means includes a support column positioned between the roof and flooring of said building structure, said support column including a slip connector mounted over the upper end of said support column, said slip connector including receptacle connectors attached radially about said slip connector.

* * * * *